US008770272B2

(12) United States Patent
Harrell

(10) Patent No.: US 8,770,272 B2
(45) Date of Patent: Jul. 8, 2014

(54) MANAGING TENSILE FORCES IN A CABLE

(75) Inventor: Thurman Harrell, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 369 days.

(21) Appl. No.: 13/110,469

(22) Filed: May 18, 2011

(65) Prior Publication Data

US 2012/0292048 A1 Nov. 22, 2012

(51) Int. Cl.
*E21B 19/086* (2006.01)
*E21B 19/084* (2006.01)
*B66D 3/08* (2006.01)

(52) U.S. Cl.
CPC ..... *E21B 19/086* (2013.01); *E21B 19/084* (2013.01); *B66D 3/08* (2013.01)
USPC ..... 166/77.4; 166/77.1; 166/85.1; 254/277; 254/392

(58) Field of Classification Search
CPC ..... E21B 19/086; E21B 19/084; B66D 3/08
USPC ..... 166/77.1, 85.1, 77.4; 414/22.51; 294/82.16; 254/277, 386, 392
See application file for complete search history.

(56) References Cited

U.S. PATENT DOCUMENTS 2,564,457 A * 8/1951 Wilson ..... 254/269
3,268,015 A * 8/1966 Stevenson ..... 173/147
3,707,922 A 1/1973 Dillon
3,718,316 A * 2/1973 Larralde et al. ..... 254/277
3,841,607 A * 10/1974 Larralde et al. ..... 254/392
3,843,096 A * 10/1974 Wilson et al. ..... 254/270
3,871,527 A 3/1975 Schimmeyer et al.
4,025,055 A 5/1977 Strolenberg
4,268,013 A 5/1981 Khan
4,349,179 A 9/1982 Barber
4,351,261 A 9/1982 Shanks (Continued)

FOREIGN PATENT DOCUMENTS

WO WO2007/145503 A1 12/2007
WO WO2011/034422 A2 3/2011

OTHER PUBLICATIONS

Authorized Officer Philippe Becamel, PCT International Preliminary Report on Patentability, PCT/US2012/038324, Nov. 28, 2013, 9 pages.

(Continued)

*Primary Examiner* — Kenneth L Thompson
(74) *Attorney, Agent, or Firm* — John W. Wustenberg; Fish & Richardson P.C.

(57) ABSTRACT

A well servicing system includes a frame adapted to mount to a pipe handling system that includes a hanger adapted to guide a load coupled to a cable towards a wellhead, where the load exerts at least a portion of a tensile force on the cable; and a winch including a drum and a brake. The brake is adapted to control rotational motion of the drum to spool a portion of the cable over the drum and set the drum to substantially prevent rotational motion of the drum. The well servicing system also includes a hydraulic piston-cylinder coupled to a sheave. The piston is adapted to stroke into or out of the cylinder when the tensile force exceeds a desired load when the drum is set to substantially prevent rotational motion to spool the cable from the drum.

22 Claims, 7 Drawing Sheets

(56) References Cited

U.S. PATENT DOCUMENTS

| | | | | |
|---|---|---|---|---|
| 4,718,805 | A | 1/1988 | Becker | |
| 5,174,389 | A * | 12/1992 | Hansen | 175/52 |
| 5,343,962 | A * | 9/1994 | Daigle et al. | 173/147 |
| 6,094,910 | A | 8/2000 | Vatne | |
| 7,900,893 | B2 * | 3/2011 | Teurlay et al. | 254/270 |
| 2003/0123957 | A1 * | 7/2003 | Jordan | 414/138.2 |

OTHER PUBLICATIONS

Authorized Officer Adri Schouten, PCT International Search Report and Written Opinion of the International Searching Authority, Nov. 5, 2013, 12 pages.

* cited by examiner

MANAGING TENSILE FORCES IN A CABLE

TECHNICAL BACKGROUND

This specification relates to systems for servicing wellbore operations.

BACKGROUND

Hydraulic Workover (HWO) systems are portable, running, and pulling systems that generally perform well bore maintenance for land, inland waters, and offshore installations. The HWO systems are used in servicing operations during which a pipe string is lowered or lifted into or out of a wellbore that is often under pressure. HWO systems employ a number of distinct sub-components which comprise the overall HWO system. Two of these sub-components are a pipe handling system and a jack. The pipe handling system may have a low capacity (and perhaps very low capacity), and may be typically only capable of handling a single piece of pipe. The pipe handling system, generally, is used to feed one single piece of pipe into the jack at a time. The jack, however, is primarily composed of extremely powerful hydraulic cylinders, which are used to move the pipe string into or out of the wellbore.

Typically, the pipe handling system is comprised of cables and a mast. In certain circumstances, an accident with injurious potential can occur if the pipe handling system does not allow cable to "spool off" of a winch of the pipe handling system after a new piece of pipe has been added to the pipe string. In this situation, the pipe handling cable can be overloaded by the jack.

SUMMARY

In one general embodiment, a well servicing system includes: a frame adapted to mount to a pipe handling system that includes a hanger adapted to guide a load coupled to a cable towards a wellhead, where the load exerts at least a portion of a tensile force on the cable; and a winch including a drum and a brake. The brake is adapted to control rotational motion of the drum to spool a portion of the cable over the drum and set the drum to substantially prevent rotational motion of the drum. The well servicing system also includes a hydraulic piston-cylinder coupled to a sheave. The piston is adapted to stroke into or out of the cylinder when the tensile force exceeds a desired load when the drum is set to substantially prevent rotational motion to spool the cable from the drum.

In another general embodiment, a method for managing a well servicing operation includes: providing a hydraulic workover (HWO) system that includes a winch system including a drum that spools a cable to raise or lower at least a portion of a load; and hydraulic jack coupled to the load; providing a cable control system including at least one sheave; and a hydraulic piston-cylinder coupled to the sheave; reeving the cable from the drum over the sheave; coupling the cable to the load, thereby exerting a first portion of a tensile force on the cable; operating the hydraulic jack coupled to the load, thereby exerting a second portion of the tensile force on the cable; detecting that the tensile force exceeds a rated load of the winch system; relieving a portion of hydraulic fluid from the cylinder through a valve, the valve having a set pressure less than the tensile force; stroking the piston into the cylinder a distance to urge the sheave in a first direction; and releasing a portion of the cable from the sheave, the portion approximately equal to twice the stroke distance.

In another general embodiment, a method for managing a cable system including a winch system having a drum with a portion of a cable spooled over the drum includes: reeving a portion of the cable spooled from the drum over one or more pairs of sheaves, each pair of sheaves having a first sheave coupled to a piston of a piston-cylinder and a second sheave coupled to the cylinder; setting brake on the drum to substantially prevent rotational movement of the drum to spool off an additional portion of the cable from the drum; exerting a load on the cable, the load exceeding a rated load of the cable; in response to the exerted load on the cable, urging the piston into the cylinder from a un-stroked position to a stroked position by evacuating a hydraulic fluid from the cylinder; and releasing a portion of the cable spanning the first and second sheaves towards the exerted load by urging the piston into the cylinder.

In an aspect of any of the general embodiments, the sheave is coupled to the frame and adapted to reeve the cable between the drum and the wellhead, the sheave adjustable between a top edge and a bottom edge of the frame based on the tensile force exerted on the cable.

In an aspect of any of the general embodiments, the sheave is a first sheave in a pair of sheaves, the pair of sheaves further including a second sheave, the first and second sheaves adapted to reeve the cable between the first and second sheaves between the drum and the wellhead, at least one of the first and second sheaves adjustable between a top edge and a bottom edge of the frame based on the tensile force exerted on the cable.

In an aspect of any of the general embodiments, the hydraulic piston-cylinder is coupled between the first and the second sheaves, the piston adapted to stroke into the cylinder when the tensile force exceeds the desired load when the drum is set to substantially prevent rotational motion to spool the cable from the drum.

In an aspect of any of the general embodiments, a hydraulic fluid system is in fluid communication with the piston-cylinder, the hydraulic fluid system including a valve adapted to relieve fluid from the cylinder based on the tensile force exceeding the desired load, wherein at least one of the first and second sheaves is urged towards the other of the first and second sheaves upon fluid relief from the cylinder.

In an aspect of any of the general embodiments, the one or more pairs of sheaves comprise two pairs of sheaves, a first pair of sheaves comprising the first and second sheaves, a second pair of sheaves comprising a third sheave and a fourth sheave.

In an aspect of any of the general embodiments, the cable is reeved over the first, the second, the third, and the fourth sheaves between the top of the mast and the drum.

In an aspect of any of the general embodiments, the first sheave and the second sheave are urged toward each other when the piston strokes into the cylinder when the tensile force exceeds the desired load.

In an aspect of any of the general embodiments, the load is supported by a jack that downwardly urges the load.

In an aspect of any of the general embodiments, the tensile forces on the cable include the load coupled to the cable and a downward force on the load due to the downwardly urging by the jack.

In an aspect of any of the general embodiments, the hydraulic fluid system valve is adapted to relieve fluid from the cylinder based on the tensile force exceeding the desired load when the brake is set to substantially prevent rotational motion of the drum to release the portion of the cable towards the top end of the mast.

In an aspect of any of the general embodiments, at least one of the first and second sheaves is urged towards the other of the first and second sheaves upon fluid relief from the cylinder to release an additional length of cable towards the top of the mast while the drum is substantially prevented from releasing the cable towards the top end of the mast.

In an aspect of any of the general embodiments, stroking the piston into the cylinder a distance to urge the sheave in a first direction includes stroking the piston into the cylinder a distance to urge at least one of the first sheave and the second sheave towards the other of the first sheave and the second sheave.

In an aspect of any of the general embodiments, releasing a portion of the cable from the second sheave, the portion approximately equal to twice the stroke distance, includes releasing the portion of the cable from the second sheave without rotating the drum.

An aspect of any of the general embodiments may also include preventing the drum from rotating during operation of the hydraulic jack with a brake.

An aspect of any of the general embodiments may also include closing the valve to direct hydraulic fluid into the cylinder based on the tensile force being less than the set pressure.

An aspect of any of the general embodiments may also include stroking the piston out of the cylinder to urge at least one of the first sheave and the second sheave away from the other of the first sheave and the second sheave.

In an aspect of any of the general embodiments, the set pressure is approximately equal to the rated load of the winch system.

In an aspect of any of the general embodiments, the HWO system further includes a mast, the rated load of the winch system approximately equal to a minimum of a rated load of the cable and a rated load of the mast.

In an aspect of any of the general embodiments, the cable control system further comprises a second pair of sheaves including a third sheave and a fourth sheave.

In an aspect of any of the general embodiments, reeving the cable from the drum over the first sheave and the second sheave includes reeving the cable from the drum over the first sheave and the second sheave and then over the third sheave and the fourth sheave and then to the hydraulic jack.

An aspect of any of the general embodiments may also include operating the hydraulic jack to exert the second portion of the tensile force on the cable, the tensile force exceeding the rated load of the winch system.

An aspect of any of the general embodiments may also include relieving the portion of hydraulic fluid from the cylinder through the valve.

An aspect of any of the general embodiments may also include stroking the piston into the cylinder the distance to urge the first and third sheaves towards the second and fourth sheaves.

An aspect of any of the general embodiments may also include releasing a portion of the cable to the hydraulic jack from the fourth sheave, the portion approximately equal to four times the stroke distance.

In an aspect of any of the general embodiments, the portion of the cable is substantially equal in length to twice a distance between the first and second sheaves with the piston in the un-stroked position.

In an aspect of any of the general embodiments, evacuating the hydraulic fluid from the cylinder includes opening a relief valve in fluid communication with the cylinder, the relief valve having a set pressure less than the exerted load.

An aspect of any of the general embodiments may also include closing the relief valve when the exerted load is reduced to less than the set pressure.

An aspect of any of the general embodiments may also include providing hydraulic fluid to the cylinder.

An aspect of any of the general embodiments may also include urging the piston from the cylinder into the un-stroked position.

In an aspect of any of the general embodiments, exerting a load on the cable includes urging a pipe string into a wellbore against a wellbore pressure in a hydraulic workover operation.

Particular implementations of a tension limiting system ("TLS") described in this specification can be implemented so as to realize one or more of the following advantages. The TLS can prevent (e.g., all or partially) a jack from applying excessive forces to a pipe handling system typically used in a HWO system. The TLS may further enable a cable to remain attached to a pipe string even when the weight of the pipe string is significantly higher than the rated load of the cable. Particularly, the TLS may reduce a possibility of breakage of the cable when forces over the rated load of the pipe handling system are applied by either or both of the weight of the pipe string or a downward motion of the jack. For example, when a brake in the pipe handling system is set to prevent or substantially prevent spooling of cable from the winch, the TLS can provide a length of cable in response to an overload event.

The details of one or more implementations of the subject matter described in this specification are set forth in the accompanying drawings and the description below. Other features, aspects, and advantages of the subject matter will become apparent from the description, the drawings, and the claims.

DETAILED DESCRIPTION

Figure 1:
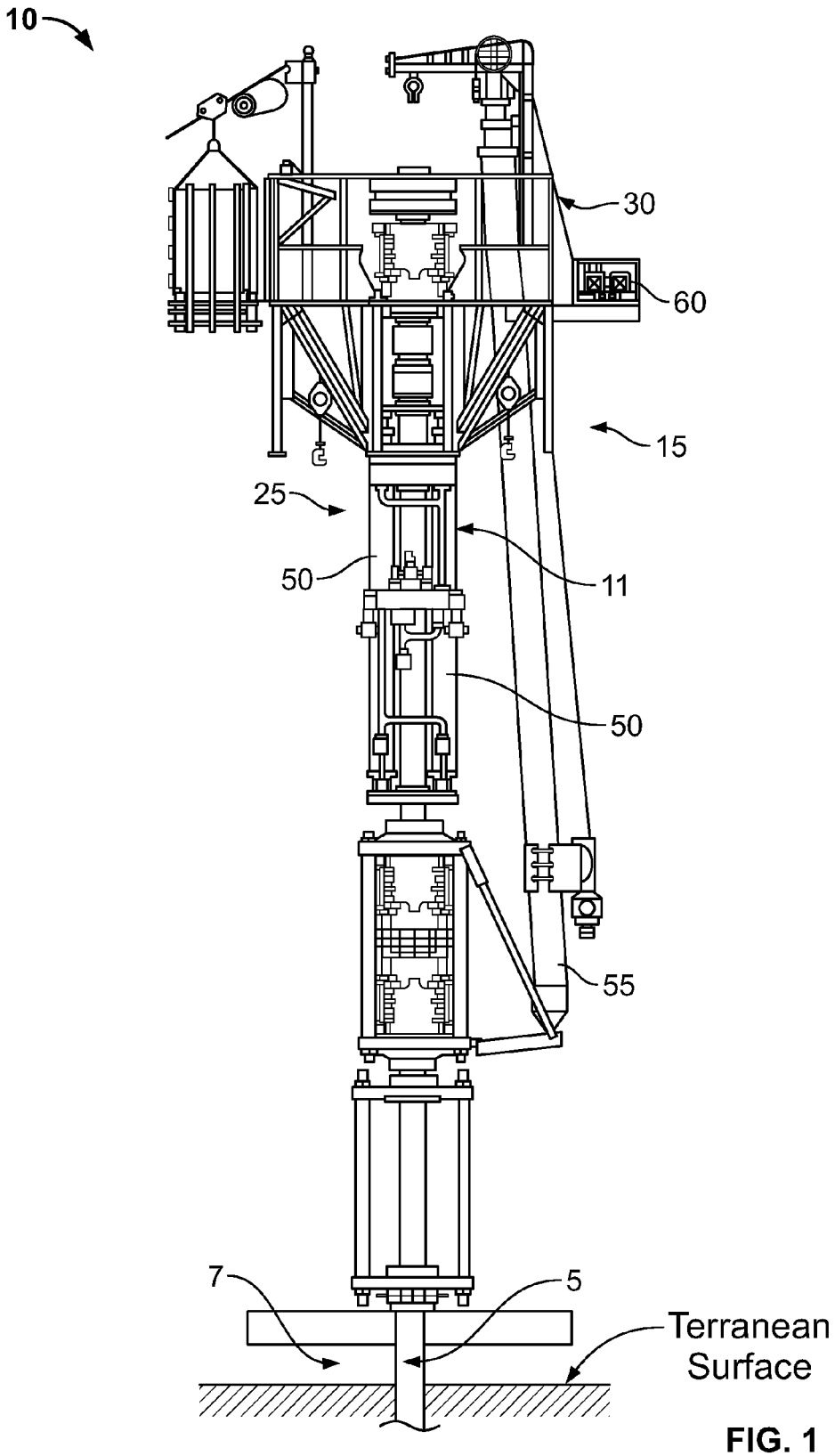
FIG. 1 illustrates an example HWO system including a pipe handling system.

In wellbore operations, a Hydraulic Workover (HWO) system is used to couple joints of pipe to form pipe strings and to lower the pipe strings into the wellbore. The HWO system can include a jack, a pipe handling system, flow controls, blowout preventers (BOPs), and other components. The pipe handling system can include a winch and a mast, which raise joints of pipe, for example, one joint at a time, from the ground or the pipe rack to the top of a jack, where the uppermost end of a pipe string is located. The jack (e.g., a snubbing jack or a HWO jack) can include one or more hydraulic cylinders, which may be used to move a pipe string into or out of a wellbore. In situations in which the wellbore is pressurized, the hydraulic cylinders of the jack can apply downward forces on the pipe string to counter the wellbore pressure. The HWO unit may also include a slip bowl to grip the pipe string being moved into or out of the wellbore. The slips are configured to hold the pipe at any point along the body of the pipe. To do so, for example, the slips can have a wedge shape, thereby avoiding the need to hold the pipe by the flared end.

The HWO system includes a mast (e.g., a telescoping mast) over which a cable, coupled to the winch, is run. To make up the new joint to the pipe string, the new joint is lifted with the winch cable which runs over the top of the mast. The winch is then operated to raise and position the joint at the top of the pipe string. The joint and the pipe string are made up, for example, by physically joining the two together (e.g., threadingly or otherwise). The winch includes a brake system that can be set and unset to prevent the winch and cable from moving unintentionally.

The cable may be subject to tensile forces due to the weight of the pipe. Additionally, the cable may be subject to tensile forces if the jack moves the pipe string downward while the winch is still connected to the end of the pipe string. In some situations, the jack is configured to move pipe strings having a weight in a range of approximately 120,000 lbs. to 600,000 lbs. The winch, on the other hand, may be rated to support a relatively lesser load, for example, 2,500 lbs. If the brake on the winch were to be unintentionally set while the jack moves the pipe string downwards, then the resulting tensile forces on the winch cable will likely cause the cable to break. In addition, in such situations, the mast and/or a structural support of the HWO unit may fail.

Thus, the possibility of the tension in the cable exceeding the rated tensile capacity of the cable exists when, for example, the cable is affixed to the pipe string, the brake system is set, and the jack moves the pipe string downwards into the wellbore. In such situations, the pipe handling system may be overloaded and may fail. To limit the tension in the cable in such situations, a TLS that is operated in conjunction with the winch, described with reference to the figures below, can be implemented. The TLS can include a sheave over which the cable can be reeved. Using, in some embodiments, a hydraulic piston-cylinder to support the sheave, the TLS can release a length of cable when the tensile forces encountered by the cable exceed a desired maximum load of the cable. In this manner, the TLS may decrease or eliminate the likelihood of the HWO jack overloading the pipe handling system.

FIG. 1 is a schematic drawing of one example of HWO system 10 that handles pipe strings employed in operations such as drilling and pumping in wellbores, for example, oil and/or gas wellbores. The HWO system 10 includes a pipe handling system 15 (described in more detail below) that is used to raise one or more joints of pipe from the ground or a pipe rack to a position where a joint of pipe can be made up to the pipe string. In addition, as the HWO system 10 also includes a jack 25 that includes one or more hydraulic cylinders 50 coupled to the pipe string to lower the pipe string into a wellbore 5, for example, by applying downward forces on the string to counter pressure exerted by the wellbore 5. During the normal downward movement of the jack 25, while the winch cable 30 is affixed to the end of the pipe string, the normal action of the pipe handling system 15 spools cable off of the winch 60 while providing a tension in the cable 30 that is within the rated working load of the pipe handling system 15. The systems and techniques described with reference to FIG. 1 and the following figures may allow the pipe handling system 15 to withstand the forces generated by the aforementioned operations.

As shown in FIG. 1, to lower the pipe string into a wellhead 7 and the wellbore 5, the HWO system 10 uses the pipe handling system 15, which may include a mast 55, one or more hangers 11, and the winch 60. The pipe handling system 15 may include a mast 55 that supports a cable 30, holding one or more joints of pipe such that the pipe handling system 15 raises the joints of pipe to a position where a joint of pipe can be made up with the pipe string. The jack 25 including the hydraulic cylinders 50 can move the pipe string into the wellbore 5, for example, by applying a force to the pipe string to overcome the pressure of the wellbore 5. In this situation, the jack 25 supports the weight of the pipe string and the joints of pipe. In addition, an operation of the hydraulic cylinders 50 to move the pipe string into the wellbore 5 applies a downward displacement to the end of the cable. In this case, the forces required to move the pipe string are orders of magnitude greater than the working strength of the pipe handling system 15. Because of this, it is considered that the hydraulic cylinders 50 apply a displacement to the end of the cable 30, as opposed to applying a force. The pipe handling system 15 further includes a counterbalance winch 60 around which the cable 20 is spooled. The winch 60 spools off cable in response to the displacement of the end of the cable 30 as applied by the jack 25.

Figure 4:
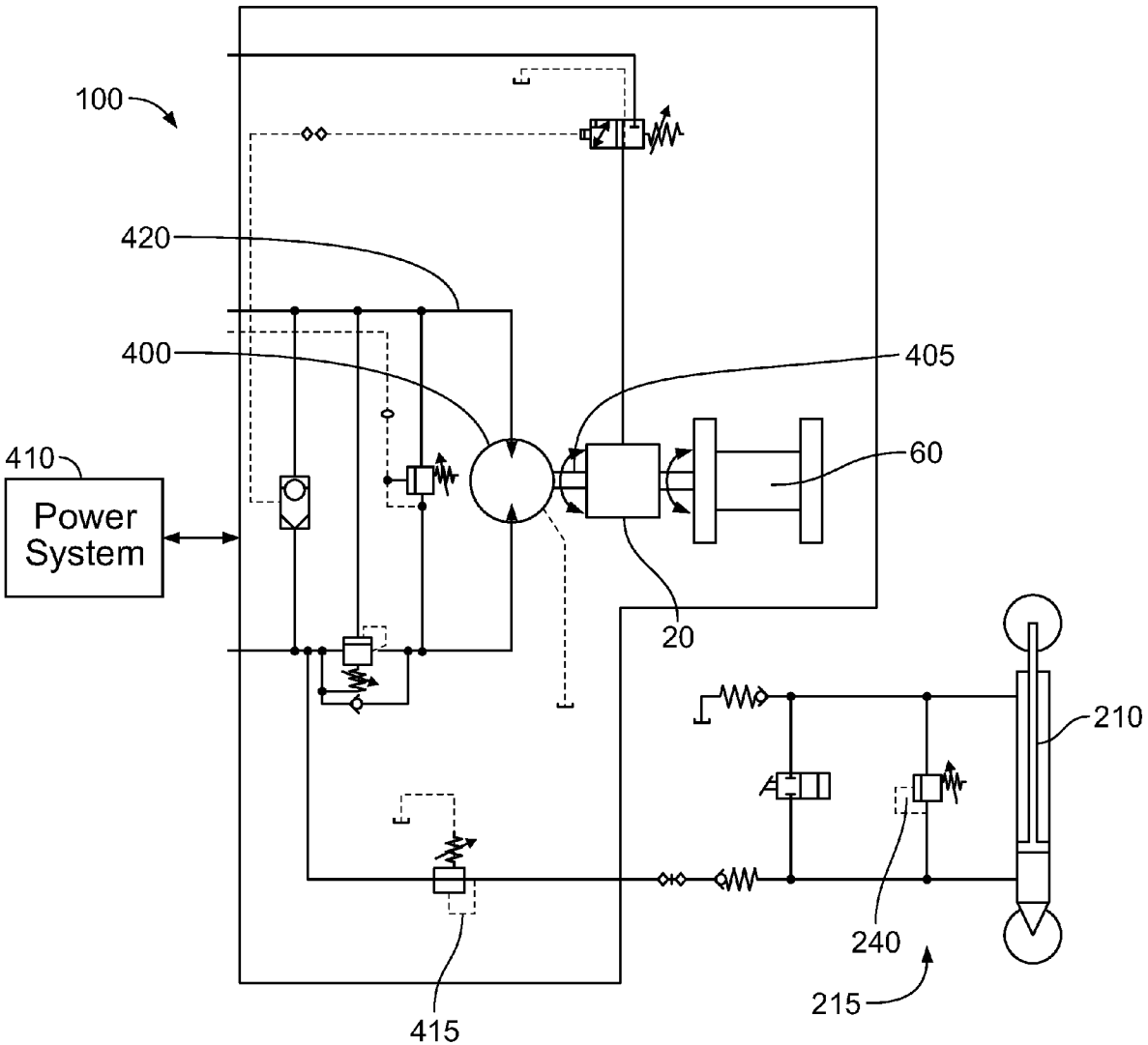
FIG. 4 illustrates an example embodiment of a hydraulic system of a TLS as integrated with the hydraulic system of a winch in a hydraulically-powered pipe handling system.

In some embodiments, and turning briefly to FIG. 4, the pipe handling system 15 can further include a brake system 20 that can prevent or substantially prevent the cable from being released by the winch 60 when the brake 20 is set. In some implementations, to do so, the brake system 20 can include a slip clutch operatively coupled to the winch 60 and the cable 30. The brake system 20 that is coupled to the winch 60 can be set at a torque rating such that, at or below the torque rating, the brake system 20 can engage a spool of the winch 60 to prevent or substantially prevent the winch 60 from rotating. An increasing load on the cable 30, either due to downward movement of the pipe string that is lowered or due to the downward displacement applied by the hydraulic cylinders 50 (or both), can cause the torque on the winch 60 to increase. The brake system 20 can have a torque rating beyond which the brake system 20 will release the clutch to permit the winch 60 to spool off. The spool off, in turn, can provide play in the cable 30 thereby preventing the cable 30 from breaking In some situations, the cable 30 from which the pipe string is lowered is rated to support a load of approximately 1,500-2,500 lbs. The hydraulic cylinders 50 can apply a downward force as high as 600,000 lbs. on the pipe string, thereby generating tension in the cable 30 in a direction opposite that of the downward force. Typically, as the hydraulic cylinders 50 apply the downward force, the winch 60 can spool off the cable 30, thereby providing play in the cable 30, absent which the cable 30 can be overloaded and can break. If the hydraulic cylinders 50 apply the downward force when the brake system 20 attached to the winch 60 is set, perhaps unintentionally, then a load on the mast 55 can increase. In such a scenario, the load on the mast 55 can be decreased by releasing a length of cable, thereby providing play. A TLS, described in more detail below, can be coupled to the pipe handling system 15 to release the length of cable while the brake system 20 remains in the set position, and therefore can prevent or substantially prevent the winch 60 from spooling off more cable 30.

Figure 2A:
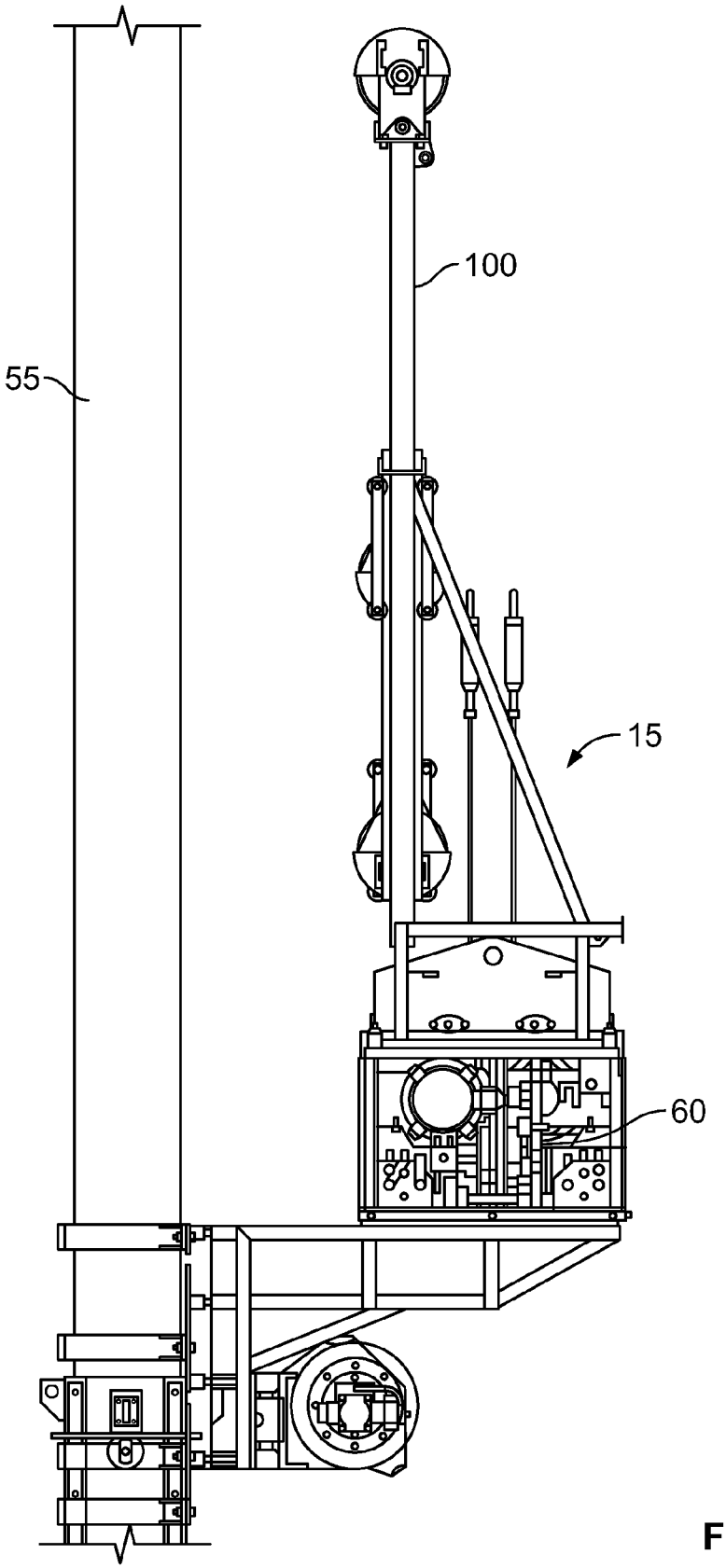
FIG. 2A illustrates one example embodiment of a TLS coupled to a portion of a pipe handling system.
Figure 2B:
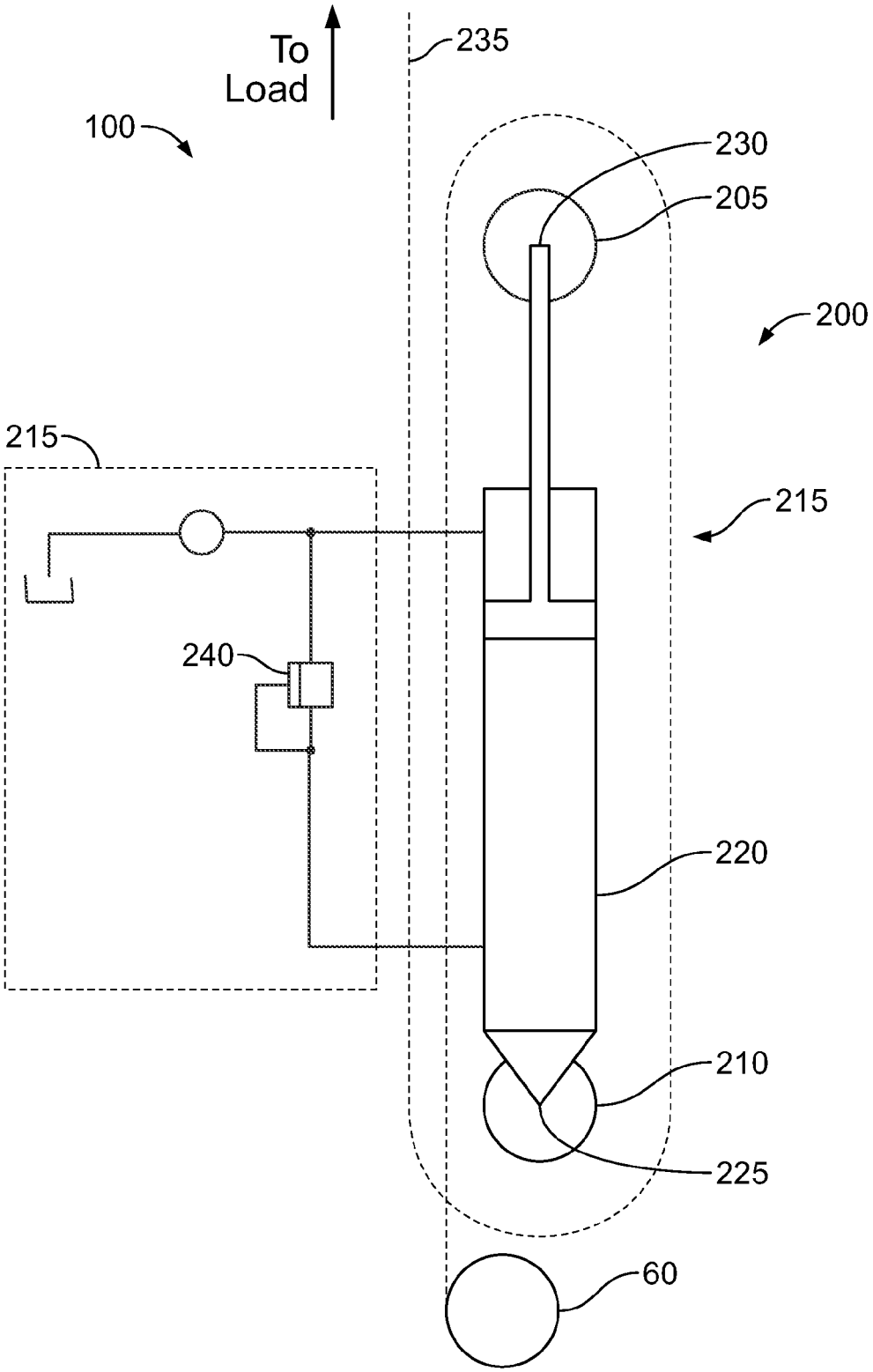
FIG. 2B illustrates one example embodiment of a hydraulic schematic of a TLS as integrated with a winch in a pipe handling system.

FIGS. 2A-2B illustrate one example embodiment of a tension limiting system 100 ("TLS 100") coupled to a portion of a pipe handling system 15. As described below, the TLS 100 includes a cable control system 200 that includes one or more sheaves (205 and 210), and a hydraulic piston-cylinder 220 coupled to at least one of those sheaves. The hydraulic piston-cylinder is a component of a hydraulic fluid system 215 in which a hydraulic fluid, disposed within the hydraulic piston-cylinder 210, functions to relieve the cable 205 of tension as the load on the cable 205 increases.

In some implementations (as illustrated), the cable control system 200 includes a pair of sheaves 205, 210. However, in alternative implementations, the cable control system 200 includes a single sheave, e.g., only one of the sheaves 205 or 210. The hydraulic fluid system 215 is coupled to each of the pair of sheaves 205, 210. The hydraulic fluid system 215 includes a hydraulic piston-cylinder 220 having a cap end 225 and a rod end 230. The cap end 225 is coupled to the lower sheave 210 and the rod end 230 is coupled to the upper sheave 205. The cable 235 is spooled around the winch 60 and between each of the sheaves 205 and 210, and is coupled to the load, for example, the pipe string. In the case of the cable control system 200 having a single sheave (e.g., one of the sheaves 205 or 210), one of the cap end 225 or rod end 230 may be coupled to a frame of the TLS 100 rather than another sheave.

In alternative implementations, the cap end 225 and the rod end 230 can be coupled to the upper sheave 205 and the lower sheave 210, respectively. In some implementations, the TLS 100 can include multiple pairs of sheaves. Each pair can include an upper sheave 205 and a lower sheave 210. The cable 235 can be reeved between each sheave (205 and 210) of each pair of sheaves.

The piston of the hydraulic piston-cylinder 220 is in an extended state when the rod end 225 is connected to the sheave 210, the cap end 230 is connected to the sheave 205, and the sheaves 205 and 210 are positioned apart, for example, as far apart on the frame as possible. As the end of the cable 235 is lowered using the hydraulic cylinders 50, the winch 60 spools off the cable 235 so that the winch cable 235 does not break. The load on the cable 235 increases when the hydraulic cylinders 50 apply a downward movement on the string. To support the load, the cable 235 is spooled off the winch 60, moving through the sheaves 205, 210. In such situations, the sheaves 205 and 210 remain apart and the hydraulic piston-cylinder 220 remains in the extended state.

In some situations, the winch 60 is set such that it cannot spool off the cable 235, for example, by a brake coupled to the winch 60. In such situations, when the end of the cable 235 experiences a downward movement, for example, either due to downward creep of the pipe string or due to a downward movement applied by the hydraulic cylinders 50 or both, then the increasing tension in the cable 235 urges the sheave 205 toward the sheave 210 until the two sheaves are substantially closer to each other. In such situations, the piston of the hydraulic piston-cylinder 220 strokes into the cylinder and is said to be in a refracted state. It will be appreciated that as the sheave 205 moves towards the sheave 210, a length of cable 235 is released, thereby providing play to the cable 235. The play provided by the released length of the cable 235 prevents the load on the cable 235 from exceeding the maximum rated load that the cable 235 can bear. The cable load at which the sheaves 205 and 210 are urged toward each other can be controlled by the hydraulic fluid system 215, as described below.

The hydraulic piston-cylinder 220 is filled with a hydraulic fluid and is in fluid communication with a valve 240 in the hydraulic fluid system 215. The valve 240 can relieve fluid from the cylinder based on the tensile force on the cable exceeding a selected load applied to the cable. In other words, as the sheaves 205 and 210 are urged toward each other under the load on the cable 235, the hydraulic fluid in the hydraulic piston-cylinder 210 is relieved through the valve 240. The valve 240, which in some embodiments may be a pressure relief valve, may be adjusted (e.g., through a setpoint pressure adjustment or other adjustment), in order to control the cable load at which the sheaves 205 and 210 move toward each other. In some implementations, as described with reference to FIG. 3, the cable 235 can be reeved over more than one pair of sheaves.

Figure 3:
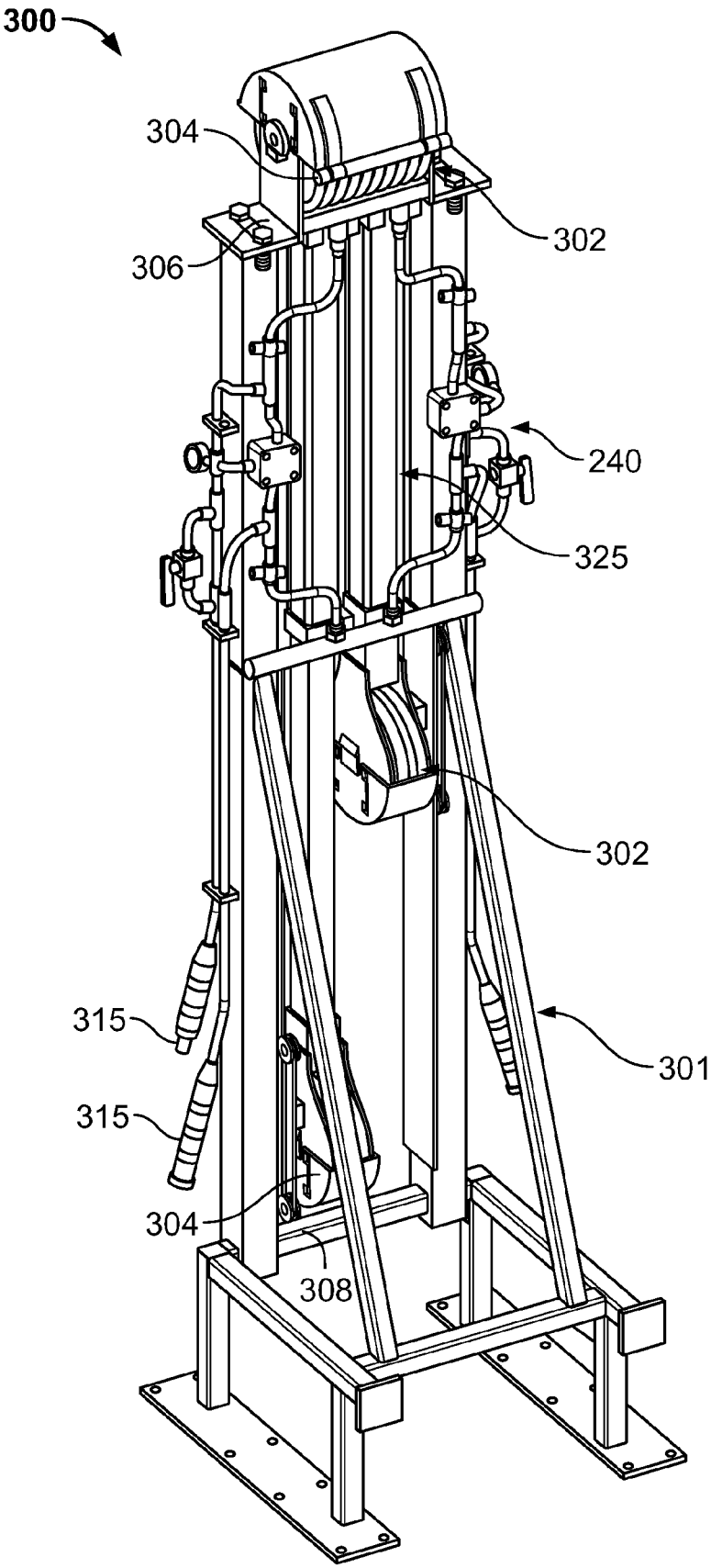
FIG. 3 illustrates another example embodiment of a TLS.

FIG. 3 is a schematic drawing of another example embodiment 300 of a tension limiting system. The TLS 300 includes a frame 301 that mounts to, for example, the HWO system 10 shown in FIG. 1. In this embodiment, two pairs of sheaves are coupled to the frame 301—the first pair 302 including a respective upper sheave and lower sheave, and the second pair 304 including a respective upper sheave and lower sheave. Each sheave of the pairs of sheaves 302 and 304 reeves a respective cable between them. Between the two pairs of sheaves 302 and 304, there are four total sheaves (sheaves 1 and 2 in pair 302, and sheaves 3 and 4 in pair 304—sheaves 1 and 3 are upper sheaves). When the cable is reeved, for example, first over sheave 1, then over sheave 2, then over sheave 3, and then over sheave 4, four portions of cable are defined over the two pairs of sheaves. When an end of the cable is coupled to the load, because of this arrangement, the load on the hydraulic cylinder is approximately four times the load on the cable.

As another example, one implementation of TLS 300 may include two individual pairs of sheaves (one pair including sheaves 304 and one pair including sheaves 302). Each pair may be independent and have a separate cable reeved over the respective pairs of sheaves. Thus, the TLS 300 may be operable to individually and independently control a play of cable from two separate pipe handling systems (e.g., from two separate winches). In some implementations, each pair of sheaves in the TLS 300 may include a separate hydraulic fluid system (such as hydraulic fluid system 215 described above).

In some implementations, the upper sheaves are attached to a top edge 306 of the frame 301 such that one of the sheaves in a pair can move towards the other sheave in the pair. In some implementations, when a tensile force is exerted on the cable that is reeved over a pair of sheaves 302, then under the tensile force, the lower sheave moves towards the upper sheave. In alternative implementations, the lower sheave is fixed on the bottom edge 308 of the frame such that the upper sheave moves towards the lower sheave under the tensile force on the cable. In some implementations, the sheaves are mounted on the frame such that the sheaves can move toward each other. In some implementations, the TLS 300 may include only a single sheave over which the cable is reeved, while the hydraulic piston-cylinder is mounted in a frame, allowing movement of the end of the cylinder which carries the sheave, for example, the sheave is mounted to either the cap end of the cylinder or the end of the cylinder rod.

The TLS 300 includes a hydraulic piston-cylinder 220 that is coupled to each sheave of a pair of sheaves. The hydraulic piston-cylinder 220 is coupled to a hydraulic fluid system that includes a valve 240 that relieves fluid from the cylinder 220 based on the tensile force of the cable exceeding its rated load. When this occurs, the mobile sheave (or sheaves in the case of multiple sheaves) moves/move in the direction of the force applied by the cable upon fluid relief from the cylinder. In some implementations, one hydraulic piston-cylinder 220 is coupled to a single sheave in the TLS 300. In alternative implementations, pairs of sheaves are coupled to a corresponding hydraulic piston-cylinder.

As described previously, the HWO system, to which the frame 301 is mounted, includes a pipe handling system. A hydraulic jack in the HWO system exerts a displacement to the end of the cable, and a winch in the pipe handling system, coupled to the cable, can spool off the cable in response to the exerted tensile force. The pipe handling system further includes a brake that substantially prevents the cable from being released by the winch when set. The valve 240 can relieve fluid from the hydraulic piston-cylinder 220 based on the tensile force exceeding a maximum desired load on the cable when the brake is set. In some implementations, the valve 240 is set to a desired relief pressure, i.e., the valve 240 will relieve fluid from the hydraulic piston-cylinder 220 when the load on the cable substantially equals or exceeds the desired relief pressure. As the sheaves in a pair are urged towards each other under the tensile load, additional length of cable is released toward the hydraulic jack while the winch is substantially prevented from releasing the cable.

The load on the cable can decrease, for example, because the entire (or a portion of the entire) pipe string has been stopped or, for example, because the hydraulic cylinders 50 have ceased to apply a downward movement on the pipe string. A decrease in the load on the cable causes a corresponding decrease in the tensile force exerted on the cable. When the tensile force decreases to a value that is lower than the tensile force that the cable is rated to withstand, then the valve 240 ceases to relieve fluid from the hydraulic piston-cylinder 220. Subsequently, through the use of a hydraulic circuit not germane to this patent, the hydraulic fluid can be communicated back into the cylinder of the hydraulic-piston cylinder 220. For example, the hydraulic fluid can be flowed through hydraulic fluid lines 315 into the hydraulic-piston cylinder 220. The piston returns to the extended state causing the mobile sheave or sheaves to be returned to the original position(s).

FIG. 4 illustrates an example hydraulic circuit of a tension limiting system, such as the TLS 100 or the TLS 300, as implemented into a winch system with a brake. As shown in the circuit, the brake system 20 and the winch 60 can be operated using a motor 400 on a common shaft 405. The motor 400 is included in a hydraulic motor system 420. The hydraulic motor system 420 and the hydraulic fluid system 215 can receive power from an external power system 410. The power system 410 supplies power to the hydraulic motor system 420 to control the motor 400 and to control an operation of the brake system 20 and the winch 60. The power system 410 can also supply power to the hydraulic valve system 215 to control a relief of fluid through the valve 240 coupled to the hydraulic piston-cylinder 220. An additional valve 415 can be coupled to the valve 240 and to the hydraulic piston-cylinder 220 to provide additional pressure relief. The valve 415 can be set to a pressure lower than the setting of valve 240.

Figure 5:
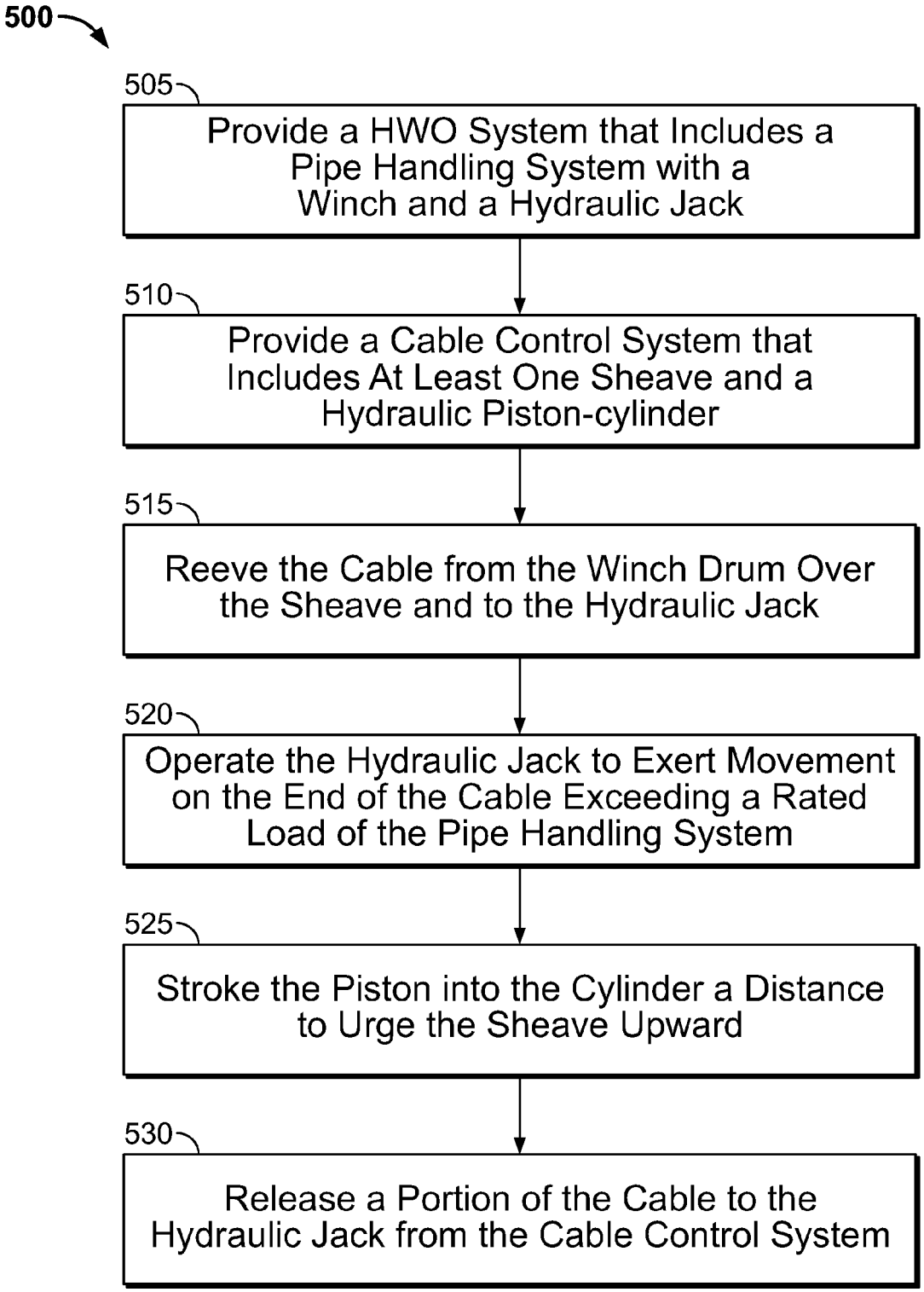
FIG. 5 illustrates one example method for managing a well servicing operation.

FIG. 5 is a flowchart of a process 500 for managing a well servicing operation. The process 500 provides a HWO system that includes a pipe handling system with a winch, and a hydraulic jack at 505. The pipe handling system can include a winch, a cable, a drum, and a motor, such as, for example, the winch 60 and motor 400 shown in FIG. 4. The process 500 provides a cable control system that includes at least one sheave (e.g., a pair of sheaves) and a hydraulic piston-cylinder at 510. In some implementations of the process 500, a pair of sheaves includes a first sheave and a second sheave. The hydraulic piston-cylinder is coupled to the sheave. The process 500 reeves the cable from the winch drum over the sheave and to the hydraulic jack at 515. The process 500 next operates the hydraulic jack to exert movement on the end of the cable exceeding a rated load of the pipe handling system at 520. Next, the process 500 strokes the piston into the cylinder a distance to urge the sheave upward at 525. The process 500 then releases a portion of the cable to the hydraulic jack from the TLS at 530.

Figure 6:
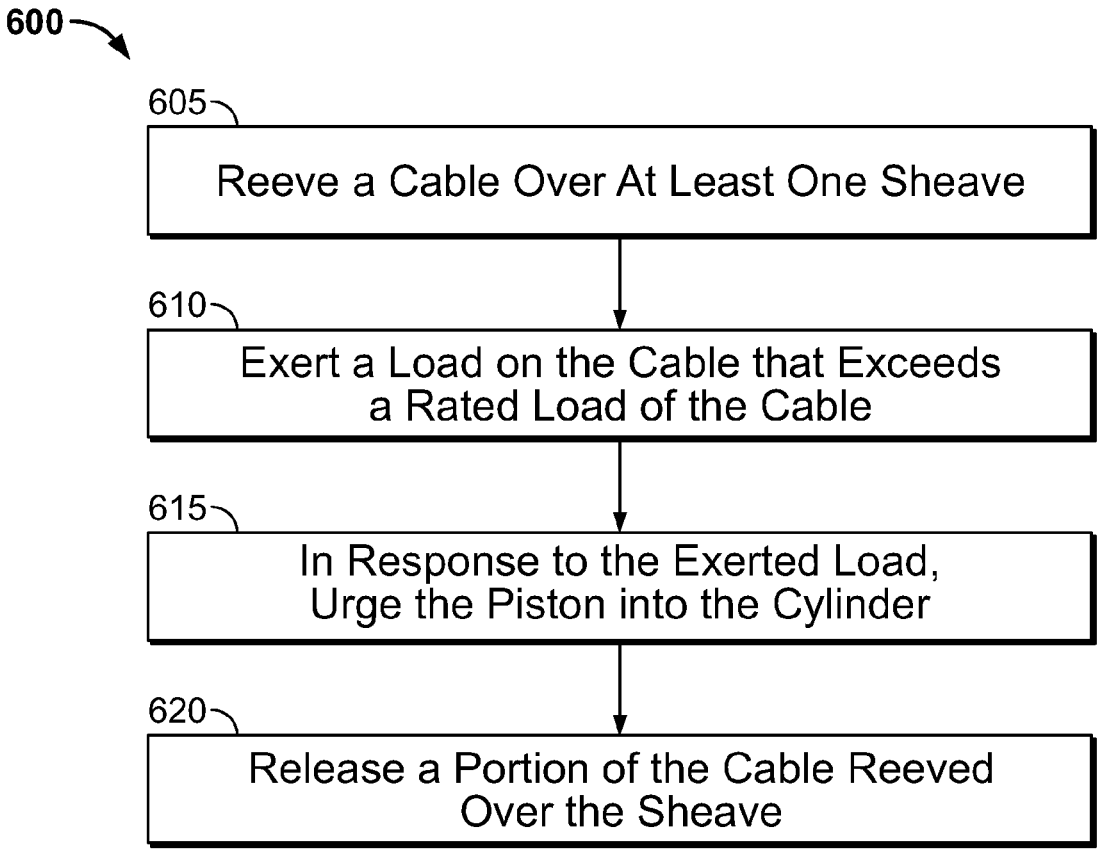
FIG. 6 illustrates another example method for managing a well servicing system.

FIG. 6 is a flowchart of an example process 600 for operating a hydraulic piston-cylinder coupled to a TLS (e.g., TLS 100 or TLS 300). The process 600 reeves a cable over one or more sheaves at 605. In some implementations of process 600, the cable is reeved over a pair of sheaves, or, in other implementations, two or more pairs of sheaves. Each pair of sheaves in such implementations may have a first sheave coupled to a piston of a piston-cylinder and a second sheave coupled to the cylinder. The process 600 exert a loads on the cable that exceeds a rated load of the cable at 610. In response to the exerted load on the cable, the process 600 urges the piston into the cylinder at step 615. For example, the piston is urged from an un-stroked position to a stroked position by evacuating a hydraulic fluid from the cylinder. The process 600 releases a portion of the cable spanning the sheave (or multiple sheaves) at 620. The portion of the cable is released towards the exerted load by urging the piston into the cylinder.

For example, in some implementations of process 600, the portion of the cable is substantially equal in length to twice a distance between the first and second sheaves with the piston in the un-stroked position. To evacuate the hydraulic fluid from the cylinder, a relief valve in fluid communication with the cylinder is opened. The relief valve has a set pressure less than the exerted load. The relief valve is closed when the exerted load is reduced to less than the set pressure. Hydraulic fluid is then provided to the cylinder and the piston is urged from the cylinder into the un-stroked position. To exert a load on the cable, a pipe string is urged into a wellbore against a wellbore pressure in a HWO operation.

While this specification contains many specific implementation details, these should not be construed as limitations on the scope of any implementations or of what may be claimed, but rather as descriptions of features specific to particular implementations. For example, processes 500 and 600 may include more steps or fewer steps. Further, processes 500 and 600 may include the described steps in different orders than those shown. In addition, certain features that are described in this specification in the context of separate implementations can also be implemented in combination in a single implementation. Conversely, various features that are described in the context of a single implementation can also be implemented in multiple implementations separately or in any suitable subcombination. As another example, while the present disclosure describes a system that is arranged such that a piston is urged into a hydraulic cylinder with the cylinder rod in compression, an alternative embodiment would allow for a retracted piston to be urged to extend with the cylinder rod in tension during an overpull event, such that the piston-cylinder coupled to the pair of sheaves may cause the piston-cylinder to be extended, rather than retracted. Thus, particular implementations of the subject matter have been described. Other implementations are within the scope of the following claims.

What is claimed is:

1. A well servicing system, comprising:

a frame adapted to mount to a pipe handling system, the pipe handling system comprising:

a hanger coupled with the frame and adapted to guide a load coupled to a cable towards a wellhead, the load exerting at least a portion of a tensile force on the cable; and a winch including a drum and a brake, the brake adapted to control rotational motion of the drum to spool a portion of the cable over the drum and set the drum to substantially prevent rotational motion of the drum;

a hydraulic piston-cylinder that is coupled with the frame and is coupled between a first sheave in a pair of sheaves that further comprises a second sheave, the piston adapted to stroke into or out of the cylinder when the tensile force exceeds a desired load when the drum is set to substantially prevent rotational motion to spool the cable from the drum; and a valve fluidly coupled to the hydraulic piston-cylinder to relieve fluid from the cylinder based on the tensile force exceeding the desired load.

2. The well servicing system of claim 1, wherein the sheave is coupled to the frame and adapted to reeve the cable between the drum and the wellhead, the sheave adjustable between a top edge and a bottom edge of the frame based on the tensile force exerted on the cable.

3. The well servicing system of claim 1, wherein the first and second sheaves are adapted to reeve the cable between the drum and the wellhead, at least one of the first and second sheaves adjustable between a top edge and a bottom edge of the frame based on the tensile force exerted on the cable, and the piston is adapted to stroke into the cylinder when the tensile force exceeds the desired load when the drum is set to substantially prevent rotational motion to spool the cable from the drum.

4. The well servicing system of claim 3, further comprising a hydraulic fluid system in fluid communication with the piston-cylinder, the hydraulic fluid system comprising the valve adapted to relieve fluid from the cylinder, wherein at least one of the first and second sheaves is urged towards the other of the first and second sheaves upon fluid relief from the cylinder.

5. The well servicing system of claim 3, wherein the one or more pairs of sheaves comprise two pairs of sheaves, a first pair of sheaves comprising the first and second sheaves, a second pair of sheaves comprising a third sheave and a fourth sheave.

6. The well servicing system of claim 5, wherein the cable is reeved over the first, the second, the third, and the fourth sheaves between the top of a mast and the drum.

7. The well servicing system of claim 3, wherein the first sheave and the second sheave are urged toward each other when the piston strokes into the cylinder when the tensile force exceeds the desired load.

8. The well servicing system of claim 3, wherein the load is supported by a jack that downwardly urges the load.

9. The well servicing system of claim 8, wherein the tensile forces on the cable comprise the load coupled to the cable and a downward force on the load due to the downwardly urging by the jack.

10. The well servicing system of claim 1, wherein the valve is adapted to relieve fluid from the cylinder based on the tensile force exceeding the desired load when the brake is set to substantially prevent rotational motion of the drum to release the portion of the cable towards a top end of a mast, and wherein at least one of the first and second sheaves is urged towards the other of the first and second sheaves upon fluid relief from the cylinder to release an additional length of cable towards the top end of the mast while the drum is substantially prevented from releasing the cable towards the top end of the mast.

11. A method for managing a well servicing operation, comprising:

with a hydraulic workover (HWO) system that comprises:

a winch system including a drum that spools a cable to raise or lower at least a portion of a load; and a hydraulic jack coupled to the load; and with a cable control system coupled to the HWO system, comprising:

at least one sheave; and a hydraulic piston-cylinder coupled to the sheave;

reeving the cable from the drum over the sheave;

coupling the cable to the load, thereby exerting a first portion of a tensile force on the cable;

operating the hydraulic jack coupled to the load, thereby exerting a second portion of the tensile force on the cable;

detecting that the tensile force exceeds a rated load of the winch system;

relieving a portion of hydraulic fluid from the cylinder through a valve, the valve having a set pressure less than the tensile force;

stroking the piston into the cylinder a stroke distance to urge the sheave in a first direction; and releasing a portion of the cable from the sheave, the portion approximately equal to twice the stroke distance.

12. The method of claim 11, wherein the at least one sheave comprises a first sheave in a pair of sheaves, the pair of sheaves comprising a second sheave, and wherein stroking the piston into the cylinder a distance to urge the sheave in a first direction comprises stroking the piston into the cylinder a distance to urge at least one of the first sheave and the second sheave towards the other of the first sheave and the second sheave.

13. The method of claim 12, wherein releasing a portion of the cable from the second sheave, the portion approximately equal to twice the stroke distance, comprises releasing the portion of the cable from the second sheave without rotating the drum.

14. The method of claim 13, further comprising:

preventing the drum from rotating during operation of the hydraulic jack with a brake.

15. The method of claim 12, further comprising:

closing the valve to direct hydraulic fluid into the cylinder based on the tensile force being less than the set pressure; and stroking the piston out of the cylinder to urge at least one of the first sheave and the second sheave away from the other of the first sheave and the second sheave.

16. The method of claim 12, wherein the set pressure is approximately equal to the rated load of the winch system.

17. The method of claim 12, wherein the HWO system further comprises a mast, the rated load of the winch system approximately equal to a minimum of a rated load of the cable and a rated load of the mast.

18. The method of claim 12, wherein the cable control system further comprises a second pair of sheaves including a third sheave and a fourth sheave, and wherein reeving the cable from the drum over the first sheave and the second sheave comprises reeving the cable from the drum over the first sheave and the second sheave and then over the third sheave and the fourth sheave and then to the hydraulic jack, the method further comprising:

operating the hydraulic jack to exert the second portion of the tensile force on the cable, the tensile force exceeding the rated load of the winch system;

relieving the portion of hydraulic fluid from the cylinder through the valve;

stroking the piston into the cylinder the distance to urge the first and third sheaves towards the second and fourth sheaves; and releasing a portion of the cable to the hydraulic jack from the fourth sheave, the portion approximately equal to four times the stroke distance.

19. A method for managing a cable system including a winch system comprising a drum with a portion of a cable spooled over the drum, the method comprising:

reeving a portion of the cable spooled from the drum over one or more pairs of sheaves, each pair of sheaves having a first sheave coupled to a piston of a piston-cylinder and a second sheave coupled to the cylinder;

setting brake on the drum to substantially prevent rotational movement of the drum to spool off an additional portion of the cable from the drum;

exerting a load on the cable, the load exceeding a rated load of the cable;

in response to the exerted load on the cable, urging the piston into the cylinder from a un-stroked position to a stroked position by evacuating a hydraulic fluid from the cylinder by opening a relief valve fluidly coupled to the piston-cylinder, the relief valve having a set pressure less than the exerted load; and releasing a portion of the cable spanning the first and second sheaves towards the exerted load by urging the piston into the cylinder.

20. The method of claim 19, wherein the portion of the cable is substantially equal in length to twice a distance between the first and second sheaves with the piston in the un-stroked position.

21. The method of claim 19, further comprising:

closing the relief valve when the exerted load is reduced to less than the set pressure;

providing hydraulic fluid to the cylinder; and urging the piston from the cylinder into the un-stroked position.

22. The method of claim 19, wherein exerting a load on the cable comprises urging a pipe string into a wellbore against a wellbore pressure in a hydraulic workover operation.

* * * * *